US008999414B2

(12) United States Patent
Lyon

(10) Patent No.: US 8,999,414 B2
(45) Date of Patent: Apr. 7, 2015

(54) DUAL USE FOOD CONTAINER

(76) Inventor: Stephen Crowell Lyon, Minnetonka, MN (US)

( * ) Notice: Subject to any disclaimer, the term of this patent is extended or adjusted under 35 U.S.C. 154(b) by 29 days.

(21) Appl. No.: 13/485,792

(22) Filed: May 31, 2012

(65) Prior Publication Data

US 2012/0315361 A1 Dec. 13, 2012

Related U.S. Application Data

(60) Provisional application No. 61/491,835, filed on May 31, 2011.

(51) Int. Cl.
*B65D 81/32* (2006.01)
*B65D 25/10* (2006.01)

(52) U.S. Cl.
CPC ..... *B65D 25/10* (2013.01)

(58) Field of Classification Search
CPC ..... B65D 81/3453; B65D 25/04; B65D 77/0433; B65D 1/24; B65D 2207/00; B65D 2543/00194; B65D 25/10; A47F 7/0071
USPC ..... 426/112, 119, 389, 394, 115, 110; 220/600, 608; 211/85.4; 229/103; 206/216
See application file for complete search history.

(56) References Cited

U.S. PATENT DOCUMENTS

| | | | | |
|---|---|---|---|---|
| 4,899,884 | A | 2/1990 | Madsen | |
| 5,065,870 | A | 11/1991 | Conder | |
| 5,203,493 | A | 4/1993 | Moody | |
| 5,971,168 | A | 10/1999 | Proulx | |
| 6,220,442 | B1 * | 4/2001 | Merrell et al. | 206/721 |
| 7,041,326 | B2 | 5/2006 | Bradley | |
| D590,126 | S | 4/2009 | Kovich | |
| D623,826 | S | 9/2010 | Griebel | |
| 2007/0228052 | A1 * | 10/2007 | Hayes et al. | 220/608 |
| 2009/0142454 | A1 * | 6/2009 | Clark et al. | 426/115 |
| 2010/0272863 | A1 | 10/2010 | Griebel | |

* cited by examiner

*Primary Examiner* — Rena L Dye
*Assistant Examiner* — Lela S Williams
(74) *Attorney, Agent, or Firm* — Quarles & Brady LLP

(57) ABSTRACT

A Dual use food container has two sets of holding surfaces, one positions food items such as taco shells for storage and transport and the other set of surfaces position the taco shell in a position for assembly so the cook can add ingredients like meat, cheese and sauce to the shell without it tipping over. The formed surfaces that enable one position exist substantially without interference with the surfaces that enable the alternative position. A thin film can be applied to the top of the container to seal the food within when positioned for storage and transport and can be adopted to fit snugly in a box further protecting the food. Thin formable materials can be used in making the container. Versions of this material can allow food to be safely warmed in an oven within the container. Methods for preparing food within the container are also disclosed.

10 Claims, 10 Drawing Sheets

300
200
201

302
100
303
303
301
300
302

400

600
800
601
500
300
705

DUAL USE FOOD CONTAINER

CROSS-REFERENCE TO RELATED APPLICATION

This application claims the benefit of provisional patent application No. 61/491,835, filed 2011 May 31 by the present inventor.

FIELD OF THE INVENTION

The present invention is related to a food container, more specifically, the present Invention relates to a food container that positions food for storage and transport and will also position food for assembly.

BACKGROUND OF THE INVENTION

Food recipes like Tacos or Gyros Sandwich start with a shell to hold the ingredients required to complete the recipe. In the case of a common taco, you would add meat, cheese, lettuce and a sauce to the shell. Because of the shape of the shell which typically has a rounded bottom, the cook is challenged with placing the shell in a position, so that the ingredients can be easily added without the shell tipping out of position and causing the ingredients falling back out which can cause a mess in the preparation area adding to a frustrating situation.

The shells used in these recipes are also both fragile and perishable. In the prior art, manufacturers such as Ortega have developed packages for their hard shell corn tacos that stack the shells together and then lay them into a vacuum formed plastic tray in a horizontal position and then be seal with a plastic film to protect the integrity. Such tray has a large cavity that cradles a combined stack of shells. Then the balance of the tray is shaped so it can fit in a rectangular box that will stand on a store shelf. Also ribbing can be found that works to cushion and keep the stacked shells from shifting once inside the box. The package used by Ortega has many features that protect the shells, but it does not have features that allow the shell to stand in an upright position in the tray that would aid the cook in completing the taco recipe.

For many food items including the example of a taco shell, packaging that invents a dual use with both storage and holding functions will give benefits to both the food preparer and the food marketer. You often see the unique type of packaging the marketer is using featured on the labels and in the advertising for the food product. This indicates that packaging features can have value in helping the marketer sell more of the product and in some cases these features can result in a customer more satisfied with the product which increases the likelihood of the customer repurchasing the product.

The packaging herein disclosed can do this for a variety of food items now on the market that require the food item to be positioned to receive additional ingredients typically added when completing a recipe. This would apply to both hard and soft-formed items, and even items not currently on the market that could be developed in the future, one example is a variety of formed shells that have recently received design patents such as D 623,826 (Griebel), which is for a formed tortilla in a tulip shape. Such shape has a rounded bottom that would make it very difficult to stand upright during the recipe assembly process without the aid of a holder.

The prior art does include inventions that position shells to stand upright during the recipe assembly process, in one patent, D 590,126 (Kovich), this problem is addressed by forming the shell with a flat bottom, but conventional packaging is still required to protect and preserve the food product. In other patents such as U.S. Pat. No. 5,065,870 (Conder) the invention is a separate stand that holds the shells, which most likely requires cleaning after use and storage between use and is not a package.

U.S. Pat. No. 5,203,493 (Moody) is an invention of a convertible taco package and holder. In this design the user is required to physically alter the package so that it will ultimately hold a shell in an upright position. This activity adds preparation time.

U.S. Pat. No. 7,041,326 (Bradley) is an invention of a food package that will store a shell such as an ice cream cone and has features that both protects and preserves the shell. Additional packaging material and space is used in this invention to create a separate compartment that would then allow the user to hold the item in a stationary position for combining the food item with other food items. This could also be defined as a package with a compartment and a separate holder, but does not integrate the holder with the compartment. Basically this package attaches a separate holding area to adjacent holding compartments and the end result takes more space and uses noticeably more package material than what would normally be found in a package that has just a storage compartment.

U.S. Pat. No. 4,899,884 (Madsen) is an invention that will store stacked ice cream shells in a horizontal position suitable for shipping and also has a separate set of surfaces that will stand the separated shells in an alternative vertical position, which will position the cone in an upright manner so that a scoop of ice cream can be placed in the open end of the cone. However, Madsen is limiting to shells of a conical shape and actually teaches away from offering a sealed package environment as the surfaces that hold the conical shells in an upright position are also holes that provide ventilation to help cool the freshly baked shells while in the container. While the holes that hold the cones upright are located in the area that also holds the shells horizontally, the two sets of surfaces are not contiguously integrated and will only work when the invention is inverted.

I know of no invention in the prior art that within a single sealed compartment has a first set of formed surfaces that are intended to protect and position the food item during transport and storage, and has a feature that will also has integrated as part of the compartment a second set of surfaces that allow the food item to stand in an alternative stationary position, with said position being an aid to the food preparation process undertaken by the end user. Additionally, I know of no prior art that has a positioning feature that is contiguously formed into other surfaces such as the storage compartment or the portion of the food package that allows the package to stand upright on a storage shelf or fit snugly in a box with said vertical holding surfaces integrated in a manner that also creates additional cushioning that further protects the food item from horizontal movement when the food item is stored and transported.

The Dual Use Food Container creates many additional opportunities for food marketers that do not exist with conventional packaging. For example, often a cook will warm the formed food shell prior to adding the ingredients required to complete the recipe. The dual use food container can also be manufactured in a material like polypropylene that can be safely heated without the material loosing its shape or affecting the food when the shells are placed in the container and then warmed in an oven. Doing this would also save the cook the extra step of placing the shells on a baking sheet prior to assembly.

Another exclusive benefit that is created by having two separate holding surfaces fully located and integrated within the compartment is the ability to collect and contain the over spill of ingredients that can occur in the assembly process.

Also included in the disclosure is a method for preparing a food item within the food container that originally held the food item or combined food items in a position suitable for storage and transportation. Taco packages currently on the market place will often have instructions to complete a taco recipe right on the back of their package. The inclusion of this information by the manufacturer is an indicator that the information is useful. With the advent of the dual use food container now disclosed herein, the need to also describe a method that incorporates the standing feature of the dual use arises.

Also included in the disclosure are details that combine in one box a stand for holding a shell like food item upright and can include some or all of the ingredients intended to be inserted into the shell to complete a recipe. The stand can also be shaped to fit in a box while it cradles the shells, with the shape of the stand also providing additional support to the box, which also protects the shells against breakage.

Taco shell manufactures currently do offer some "kits" that combine various shells with other ingredients such as seasoning and sauce all in one package. An illustration of one example of this can be found in U.S. Patent Application Publication 2010/0272863 (Griebel). Ortega also offers several kits and at least one that includes a collapsible stand described in U.S. Pat. No. 5,971,168 (Prouix). The creation of kits by major taco shell makers such as Ortega and General Mills which is the distributor of the Old El Paso brand and the assignee of many taco shell related, USPTO Patents, such as Griebel (D 623,826) is an indicator that what is offered in the way of kits is useful and appealing to their customers.

With the advent of the dual use food container now disclosed herein, new opportunities exist for the creation of kits that include the dual use food container and or a dual use stand that will help facilitate standing the shell upright as the end user completes the recipe. Unlike the collapsible stand found in the Ortega kit, the stand included in the kit disclosed herein will also protect the food product when stored and transported.

Additional new opportunities also exist when the dual use stand or dual use food container is made out of heat resistant materials which will allow the user to place the recipe ingredients within the shell and then placing it all within the stand which can then be warmed in the oven.

BRIEF DESCRIPTION OF THE DRAWINGS

The invention is pointed out in the claims. However, a more complete understanding of the present invention may be derived by referring to the detailed description and additional specification when considered in connection with the figures, wherein like reference numbers refer to similar items throughout the figures and:

DETAILED DESCRIPTION

The description and additional specification set out herein illustrates the various embodiments of the invention and such description is not intended to be construed as limiting in any manner.

Figures 1, 2, 3, 4:
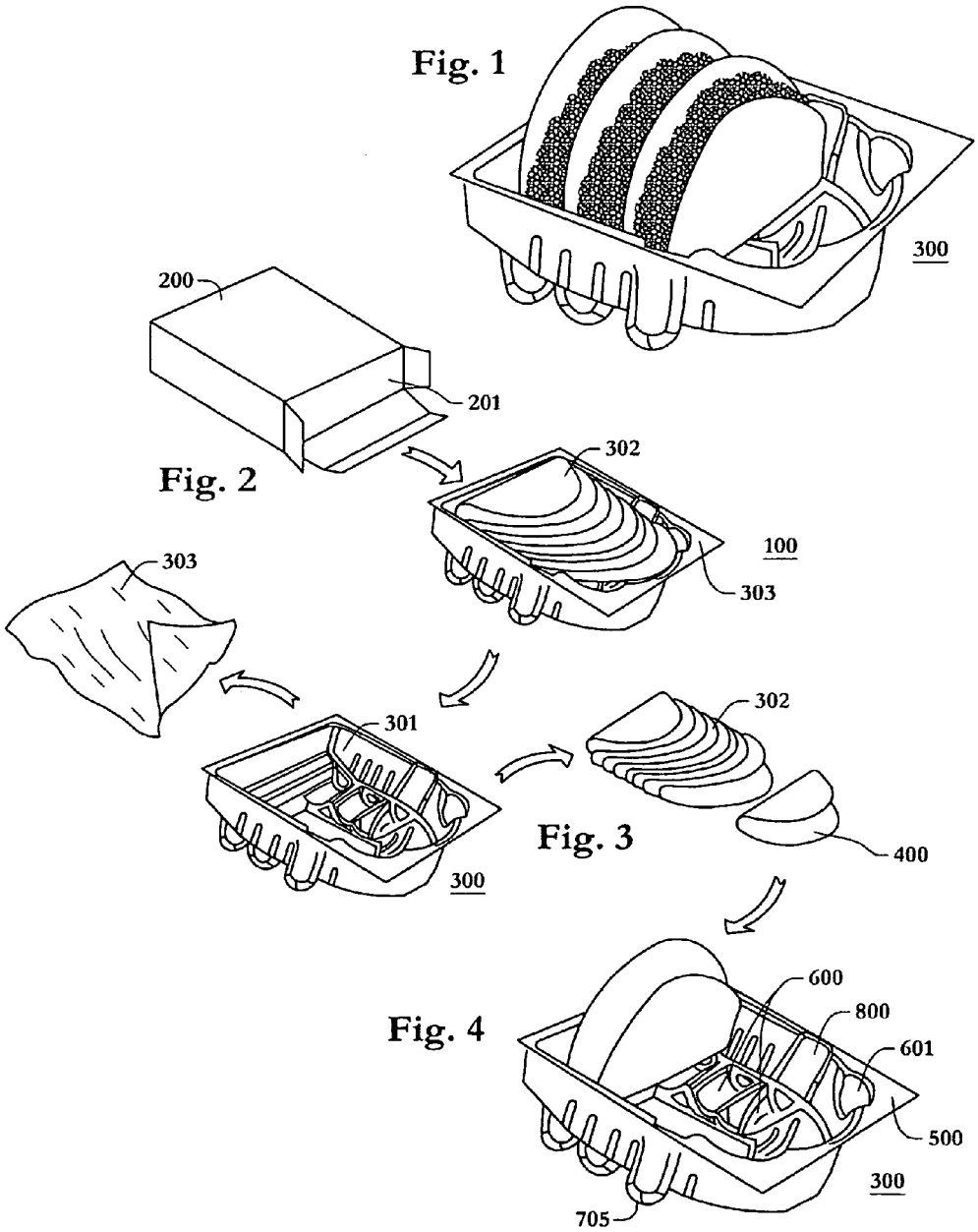
FIG. 1 is a perspective view of the dual use food container; it appears here with shells that are placed in the position that makes sense for food assembly according to an embodiment of this invention.
FIG. 2 is a perspective view of the dual use food container, as it would appear in a package configuration according to an embodiment of this invention.
FIG. 3 is a perspective view of the dual use food container as shown in FIG. 2 being opened with the shells removed with most of the shells stacked into each other which is a similar configuration of how the shells were found when inside the food container according to an embodiment of this invention.
FIG. 4 is a perspective view of the dual use food container holding a food shell in a new position that can occur once the shells have been separated from each other according to an embodiment of this invention.

The drawings in FIG. 1 and FIG. 2 illustrate two configurations of a dual use food container, according to an embodiment of this invention. In FIG. 1, a configuration that enables the assembly of food is illustrated. In FIG. 2, the package configuration is illustrated. Both configurations will be detailed further in the text and additional illustrations that follows.

The drawings in FIG. 2 and FIG. 3 show two phases of the package configuration of a dual use food container as the container is opened and then as the food items in the container are removed. The first phase which is shown in FIG. 2 shows a box 200 that is opened on the end 201 from which the dual use food container 100 has been removed. The second phase is shown in FIG. 3 and this shows the food items 302 removed from the base member and you can now see the food compartment 301 from which the 302 combined multiple of food shells were stored prior to their removal. You will also note that a film 303 has been removed which previously sealed the food items 302 within the container.

Figure 6:
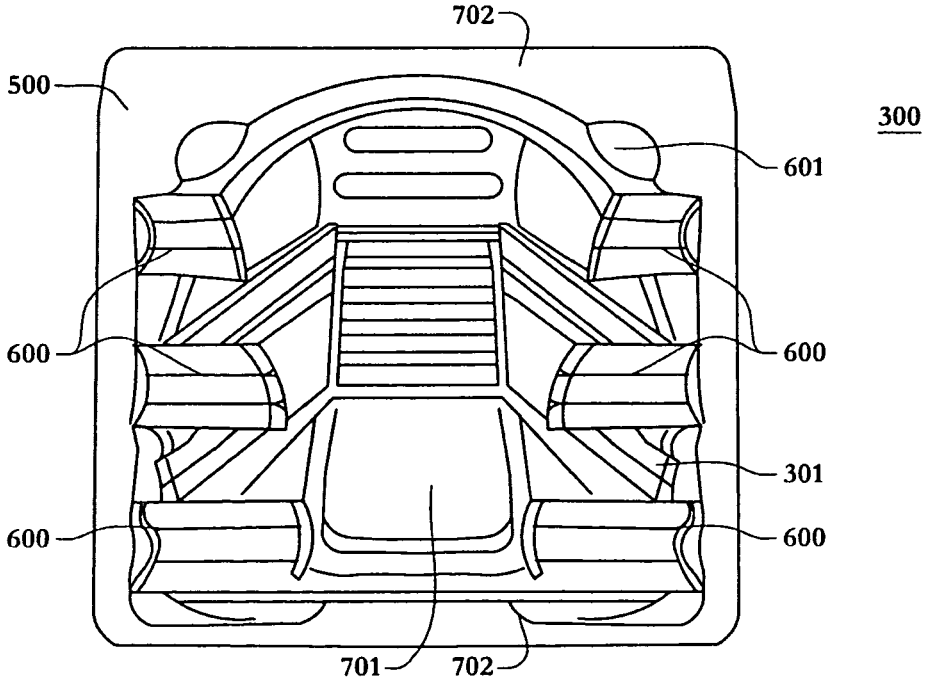
FIG. 6 is a top view of the dual use food container with the shells removed according to an embodiment of this invention.
Figure 7:
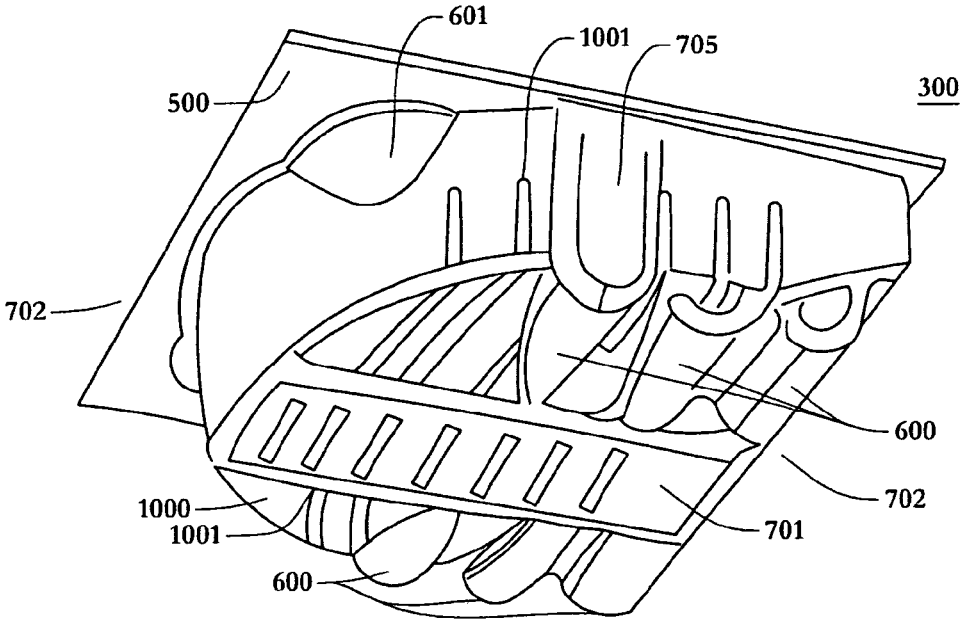
FIG. 7 is a perspective view of the underside of the dual use food container according to an embodiment of this invention.
Figure 8:
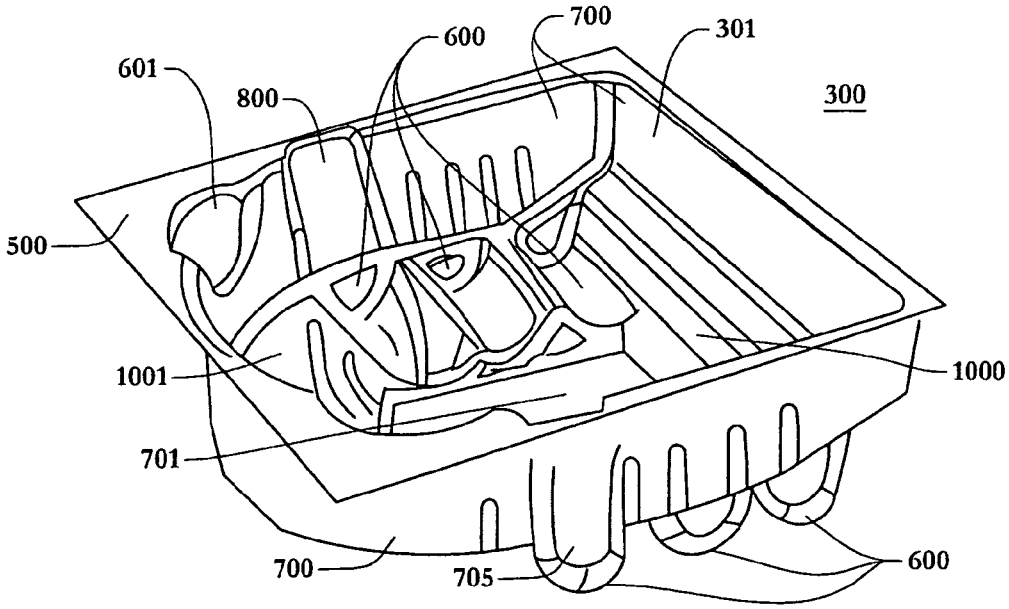
FIG. 8 is a perspective view of the inside of the dual use food container according to an embodiment of this invention.
Figure 9:
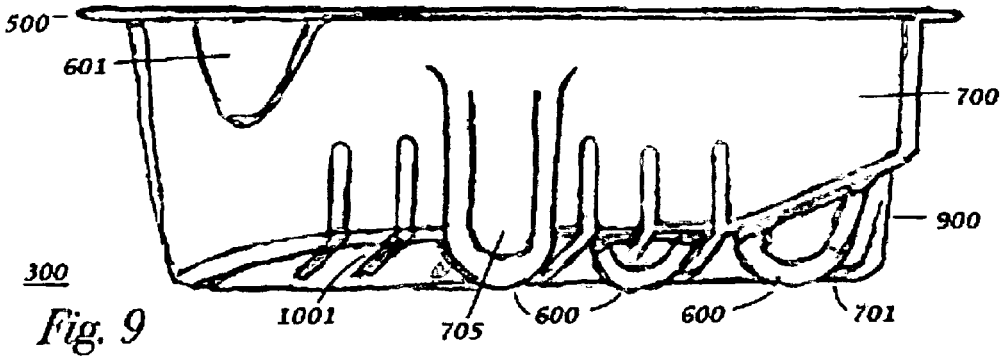
FIG. 9 is a side view of the dual use food container according to an embodiment of this invention.

FIG. 6 and FIG. 8 all illustrate the food container 300 when food is not contained within and after the seal 303 has been removed, the 300 is also referred to as the base member and when it includes a seal it is identified as 100. FIG. 7 and FIG. 9 show the same food container 300 but from different views. These four figures will be used to illustrate what comprises an embodiment of this invention.

The base member 300 has a top portion generally designated 500, the compartment 301 is below the top portion 500, the compartment has a sidewall that is contiguously formed around all sides of the compartment which is generally designated 700, and then the bottom is designated 701. The sidewalls 700 are formed in a generally perpendicular manner to the top surface 500 and the bottom of the base member 701 is also formed generally perpendicular to the 700 sidewalls, so that the top and bottom surface are parallel to each other. FIG. 9 is a direct view of one part of the 700 sidewall. FIG. 9 also shows a 900 supporting structure that transitions the bottom 701 of the base member 300 into the compartment structure 301. This provides consistent support so that the base member can have effective food holding surfaces based on a predetermined level when the base member 300 is placed on generally flat surface such as a kitchen counter Note that the surfaces of the container 300 are contiguous and flowing in nature. This is because they would be molded based on the items they were intended to hold, so that the molded surfaces would closely envelop the item it holds.

In FIG. 9 we label and show the 700 sidewalls, the 900 supporting structure, the 701 bottom and for each it can be said that these surfaces make up the other side of the compartment surfaces 301, considering these all at once is illustrative of the contiguous nature, whereas one segment would meld with others forming a whole unit that is also referred to as the 900 supporting structure. The purpose of the 900 supporting structure is to is to support the food container 300, so that the top surface 500 would be parallel to the flat surface (e.g., kitchen counter) that it would rest on.

Figure 5:
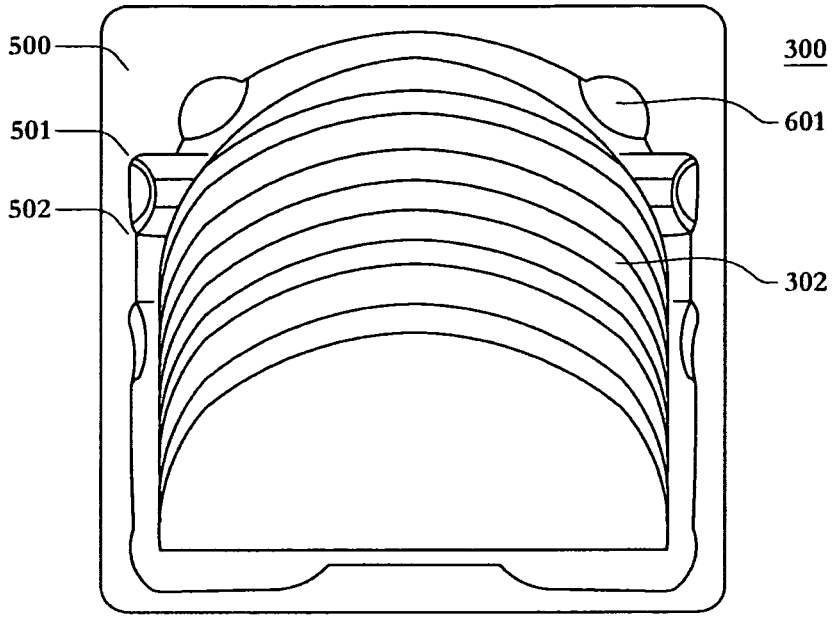
FIG. 5 is a top view of the dual use food container holding a stack of shells inside the tray in the position intended for storage and transport of the shells according to an embodiment of this invention.

One material that could be used to form the food container 300 in one contiguous piece of an embodiment such as this would include plastic that is formed using a molding method. Many food trays found within a outer food package box use these methods and materials, one that many people are familiar with would be the plastic tray that is found inside a box of fine chocolates such as the heart shape cardboard boxes that are very popular as Valentines gifts. FIG. 9 illustrates from the side that the top surface 500 is flat, while FIG. 6 and FIG. 5 illustrates that the four corners of the top surface are generally square. Also FIG. 9 shows how the food container can have a contiguous supporting structure 900 made up of side walls 700 and base surfaces 701 that are designed to rest on a generally flat surface and when they do the overall bottom surface 701 would be parallel to the top surface 500 because of the predetermined dimensions used in making the supporting structure 900.

The structure that results can fit snugly in a box, which is beneficial to food storage and transport. This is because much of the dry grocery transportation and retail systems are designed around containers that are square. One reason is the square nature allows the container to rest stably on a store shelf and also allows additional containers of like size to be stacked on top. Having a base member of a square or rectangular cube design can make the container more rigid and reduce the shifting of that base member when in the box, meaning the food items stored within the base member are less subject to movement and breakage. As the drawings illustrate an effectively square design that adopts the food container 300 to the box 200 that could hold it. This can be accomplished even though many of the formed surfaces are rounded. This is because as the food container 300 is dimensioned, the designer is considering how it will ultimately fit in a box or sits level on a shelf. One example of how this would be done can be illustrated using FIG. 11, here you would want the height of the food container 300 as measured between the bottom point of the support areas of 1100 and the top of 500 to be only slightly smaller than the inside height of the box it will go in. Another example that illustrates this is FIG. 6, where you can see the rectangular shape of the top surface 500, the box 200 it would go in would have a similar shape but only slightly larger.

Figure 12:
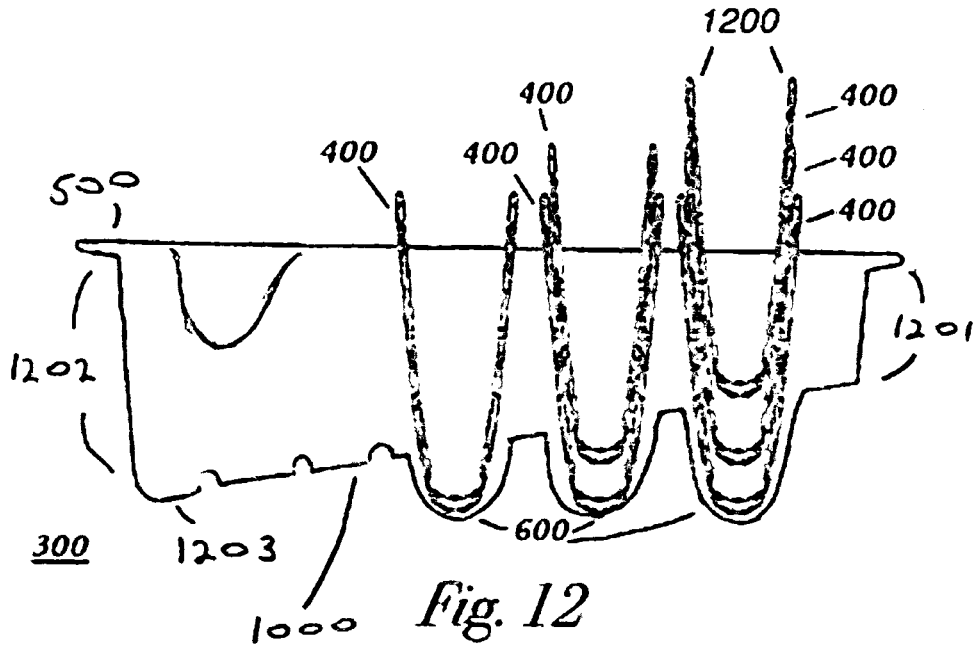
FIG. 12 is the same cross-sectional view as shown in FIG. 10, this is shown with shells separated from the stack shown in FIG. 10, and placed in the position intended for food assembly with some shells still stacked together according to an embodiment of this invention.

Dimensioning a container to fit in a box such as this is found in the prior art and can be very well witnessed in the Ortega brand taco shell food container and outer box that is prevalent in the market place today. This disclosure does not take credit for this method of design. What you will find in the specification and claims that follow, is an invention that takes additional and novel steps to include two separate holding surfaces, each with its own purpose, in the same size box 200 that a conventional food container can now be held in. Several of these additional and novel features are based on the food container being dimensioned in a manner where it is held in a level position, this is so the two sets of holding surfaces can be integrated with each being effective in its respective position based on the food container being in a level position. Generally in the first embodiment of the invention, when the shells shown in FIG. 10 are in the first position, the position that enables storage and transport they are horizontal, when in the second position that enables food preparation the shells 400 are in a vertical or upright position as shown in FIG. 12.

Figure 10:
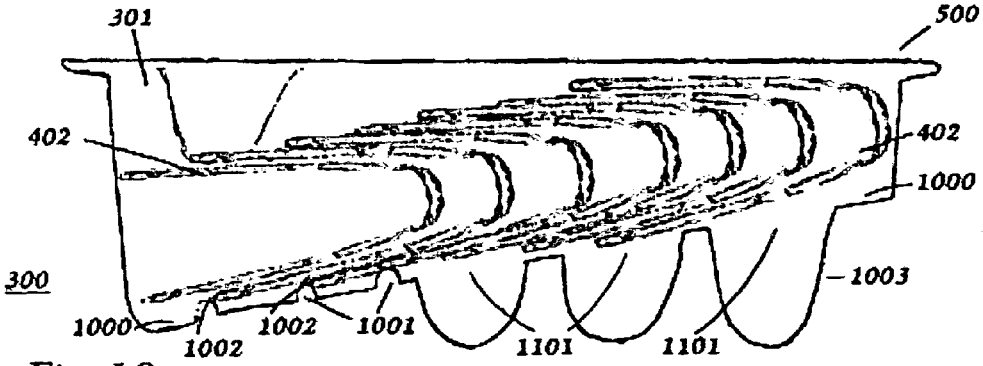
FIG. 10 is a cross-sectional view of the dual use food container taken along line 702—of FIG. 5 and FIG. 6, which is a line that divides off roughly one third of the container or a side section, it is shown with a stack of shells inside the tray according to an embodiment of this invention.
Figure 11:
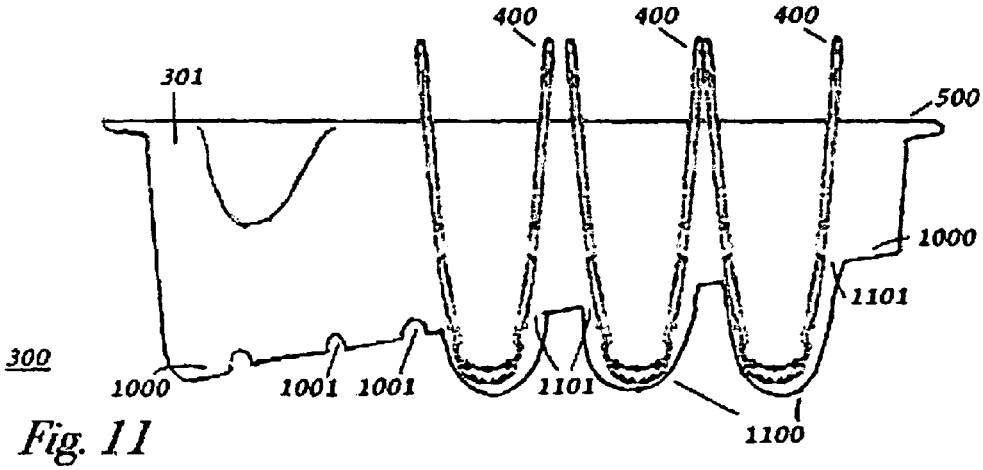
FIG. 11 is the same cross-sectional view as shown in FIG. 10, this is shown with three of the shells separated from the stack shown in FIG. 10 now placed in the position intended for food assembly according to an embodiment of this invention.

FIG. 10 illustrates one of the shell positions created by one of the sets of holding surfaces while FIG. 11 illustrates the other. FIG. 10 shows a combined quantity of shells 302 in a horizontal position, which is a compact shell configuration, and a horizontal position that enables storage and transport. FIG. 10 illustrates, that when the shells are separated they can now stand upright as they rest on the second set of surfaces that position the shell for food preparation. This is when the open end is upright allowing the ingredients such as meat and cheese to be added into the open area of the shell.

Viewing FIG. 2 and FIG. 3 along with the cutaway view in FIG. 10 all illustrate the 302 food items in a position that enables food storage and transport. This function is considered enabled for several reasons to include that, when items are combined they take up less room, also the shape of the compartment 301 is closely molded to the shape of the combined shells 302, which minimizes movement of the food product which can cause breakage. The position of the food items or shells you see illustrated in the cutaway of FIG. 10 and how the container closely envelops the combined quantity of food items or shells is similar to what is found in the Ortega freshness pack. What is not found in the Ortega package is the integration, a part of which is illustrated in FIG. 10 in the three designated areas labeled 1101.

Further conventional elements are also illustrated in See FIG. 10. Note in this configuration the combined shells 302 are tilted on a surface that looks like a ramp 1000. You will also note the ridges 1001 that are spaced along the ramp 1000 and how they are aligned with the edges of the shell at the point labeled 1002, these ridges along with the tilt of the ramp 1000 help position the food items in the 301 compartment and provide resistance at these points 1002, which works to reduce movement of the food items. The tilt or level above the supporting plane is predicated based on how the compartment 301, and supporting base structure are dimensioned. The entire structure of the base member 300 that is greater than the size of the combined shells 302 protects the shells as it provides both a buffer zone between the food and the container outside that helps absorb the up and down and sideways movement of the shells that can occur in transit, that movement is also restrained when the shells are sealed into the compartment via a film 303 on top.

In FIG. 5 you see how this container appears from above after the film 202 has been removed still containing the stack of shells 302. FIG. 6 is the same overhead view after the shells have been removed, which now allows you to see the formed surfaces 600 that hold food in the position that enables food preparation. You will also note in FIG. 5 how the compartment 301 is configured to hold the combined food items 302. The predetermined configuration has the opening of the food compartment 301 being slightly larger than the shape of the combined food items 302 this results in a minimal level of shifting and movement that also protects the food item. To still allow the combined food item 302 to be easily removed by the cook finger access holes 601 have been formed.

FIG. 5 and FIG. 6 also illustrate how the formed surfaces 600 that enable food preparation are contiguously integrated into the compartment 301. An example of this can be witnessed at 501, at these points in a conventional container design the arc shape of the compartment perimeter would just continue along the curve of the combined shells 302 it holds, but the dual use food container instead takes a tact that briefly interrupts the arc of the curve and adds space that will serve to hold the shell in the alternative position that enables food preparation and then after that space has been created, the arc that follows the shape of the combined shells which continues back on its original path returning to the purpose of closely surrounding the combined food item 302. You will see more examples of this integration in the drawings that follow as well as the corresponding text.

The integration shown in FIG. 5 and FIG. 6 is a two dimensional illustration, the third dimension of that integration is shown illustrated in FIG. 7 at point 705 where you can see the back side of the formed surfaces 600 that aid in food preparation extending slightly away from what would be the compartment space found in a conventional design, refer now to 800 in FIG. 8 to see the other side of point 705, which is the side of the holding surface where the food item 400 will touch and be held at one of its end, which is across from an oppositely placed formed surface 705 that will hold the other end.

FIG. 11 is a cutaway view that shows food shells 400 that have been separated from combined shells 302 and then placed into the food container 300 in the position that enables food preparation that hold the shell in a stationary upright position. Thus the area of the base member 300 where the material 600 extends to also act as supporting structure 900 finds a different use as it now becomes a formed surface that hold the food item 400 in an alternative stationary position that enables food preparation. Thus one side of 1100 material is supporting the structure so it best fits in a box while the other side of the 1100 material will hold a shell upright.

The predetermination used to place the holding surfaces 1100 can also be done in a way were the multiple of shells are held so that the bottom of each holding surface reaches the same low point so that the low points then serve to support the container when it is placed on a flat surface, so that the top of the container 500 is parallel to that surface. This integrates the holding surfaces in a way were the food container 100 will fit snugly in the box. Also the food preparation holding surfaces provide a cushion between the bottom of the box and the combined food items when the container 100 is placed in the box when the food container is in the mode that stores food.

You will also note that the shells 400 in this position extend above the top surface 500, which gives the cook improved access to add and remove the shell from the base member 300. However, in this position the square environment, which facilitated storage and transport, is no longer maintained or needed because the container is now in the after opening mode that enables food preparation, with the food container 300 being removed from the box 200.

In FIGS. 10 and 11 you will also note the surface has gaps at points labeled 1101, note that these gaps 1101 have been integrated in such a way that the combined shells 402 are in roughly the same position they would be in had the gaps 1101 not been integrated and the ramp like surface 1000 was one uninterrupted sloping line. Also note that where the gaps are material dips down 1003 to form space for holding the shells 400 upright and that space is dimensioned in a way that keeps the top surface 500 parallel to the bottom plane of the container which continues to allow the container to fit in a box. In a conventional container design you would also find supporting structures that allow the base member to fit in a box, however the supporting structure in a conventional design does not include formed surfaces 600 that have the additional purpose of holding a food item in an alternative position that enables food perpetration. Also note that the formed surfaces 600 that hold each shell upright have been integrated into the ramp like surface 1000 of the compartment 301 in a manner that will have little or no effect on the surfaces ability to continue to hold and position the combined food items 402 when the food container is being used in the storage and transport mode.

FIG. 7 and FIG. 8 show how the compartment 301 is contiguously formed as part of the base member. The top 500 of the base member 300 is a flat surface with the compartment 301 formed below that. In FIG. 8 you see the inside walls 700 that form the compartment 301, while in FIG. 7 you see the outside of the sidewalls 700 that form the compartment 301. The outside wall 700 is also noticeable in FIG. 9. Note how the walls that form the compartment also provide lateral supporting structure that positions the base member when on a generally flat surface.

The predetermined formed surfaces 600 that hold the food product in an alternative stationary position are also demonstrated in FIG. 4, FIG. 6 and FIG. 8., which all allow a closer look at the inside of the compartment 301. In each you will see the formed surfaces 600 that function to hold the food shell 400 in positions that enables food preparation, these formed surfaces are labeled 600. In these illustrations the tray has three sets of the formed surfaces 600 that would hold three food items 400, each set is a pair of two holding surfaces 600 and between the pairs you will find space that serves as the ramp surface 1000, and the other side of the space that serves to support the base member on a flat surface, which also provides an additional space below 900 and to the side of the shells that can serve as a drip pan to catch ingredients that have soaked through the shells or in the process of assembly have missed the shells.

In FIG. 4, note that one shell 400 is held in the predetermined position by the formed surfaces 600 that are under the shell. However, you can see two more sets of formed surfaces 600 that will hold more shells. When full this embodiment has three places to hold shells as we show it full in FIG. 1, the numbers of places for shells will vary also based on how much length the food container 301 has, so if longer 4 or more spaces can be created.

When looking at the inside the compartment 301 views notice how the formed surfaces 600 that hold the food are integrated with the surfaces for storage and transport. For example, a non-integrated surface for holding tacos would not normally have the gaps like you see at point 1101 in FIG. 11. However, because the shell is still supported by the formed surfaces 600 on each side, the function that holds the shells in a position for food preparation still occurs while still allowing the integration that also allows the shells to be held in the configuration for storage and transport. Gaps that are described here can be found in this as well as the other examples of surface integration described earlier, that is a primary reason that the two surfaces exist and can function without significant interference with the surfaces that enable the alternative position, thus creating a dual use for the food container. The placement of such gaps will vary based on many factors including the dimensions of the food item or combined food items being stored and the structure of that item. A few objectives of such placement include, gaps that are large enough to create holding surfaces to exist yet they are not too large so that support to the stored food item and the deterrence to food item movement are not significantly compromised. In both modes the holding surfaces would be dimensioned to closely envelop the food item that it is holding, so that the surfaces will hold the food item in a stationary position in each mode. In the case of the dual use food container, you will not entirely envelop the food item or items with support material, as space does need to be left to accommodate the alternative position. Integration is based on considering the two positions and providing support material for each position, without having the two sets of surfaces interfering with each other. Another consideration in the integration is how the supporting structure 1100 can be shaped to also hold the shells in the upright position as illustrated in FIG. 11.

FIG. 12 is similar to FIG. 11, as both show shells held in the upright position for food preparation. Shown in FIG. 12, is more than one the shells 400 is stacked on top of another food item 400. This is to show the ability of the three holding surfaces 600 to hold more than one food item 400 each. This can allow the cook to take a container that would hold lets say 12 taco shells, and with those place three stacks of four in the container 301. The cook would then complete the recipe by filling the top shells first, then remove them and then fill the newly exposed shells next, and follow that sequence until all the shells are filled with the desired ingredients.

Figure 13:
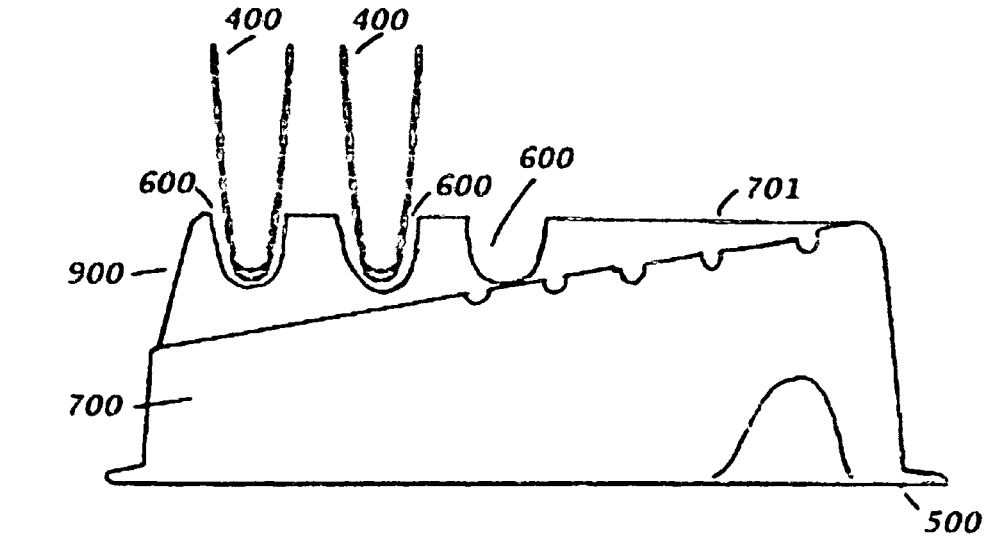
FIG. 13 is a side view of another embodiment of a dual use food container that has been turned to lay in a position intended for food assembly that shows food items held in that position according to an embodiment of this invention.

FIG. 13 shows a different location for the formed surfaces 600 that enable food preparation. The base member 300 is turned over so the top surface 500 is in contact with a generally flat surface. Note that in this position the formed surfaces 600 for holding have been contiguously integrated in the supporting structure 900 and the flat surface that makes up the bottom 701 of the base member. While the base member 300 is in an upside down position, note that the compartment 301 is the same basic shape as it is shown in FIG. 10 and in this embodiment has the same ability to hold the combined food items 402 in the position that enables food storage and transport as demonstrated in FIG. 10. Also this shape has flat parallel surfaces, 500 and 701 on the top and bottom can still fit in a box 200 in much the same manner that the previously illustrated embodiments do.

Figure 14:
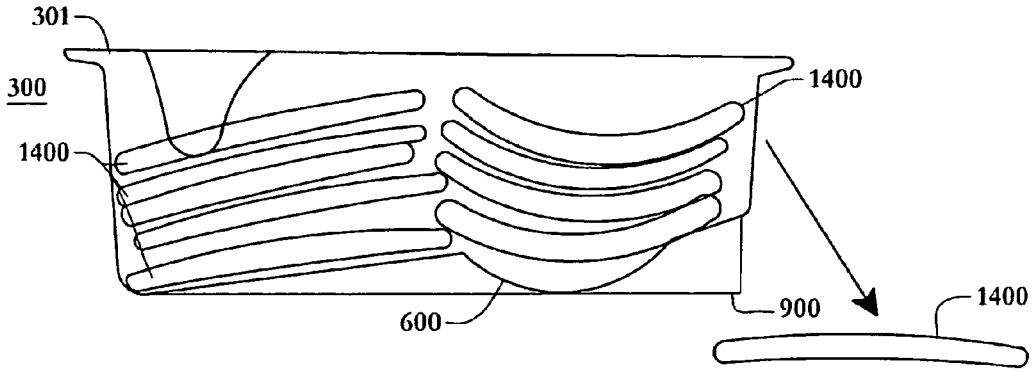
FIG. 14 is a cross-sectional view of another embodiment of a dual use food container with the view taken along the middle line that splits the container into exact half's, this is shown with bendable food items in the positions intended for food storage and transport, according to an embodiment of this invention.
Figure 15:
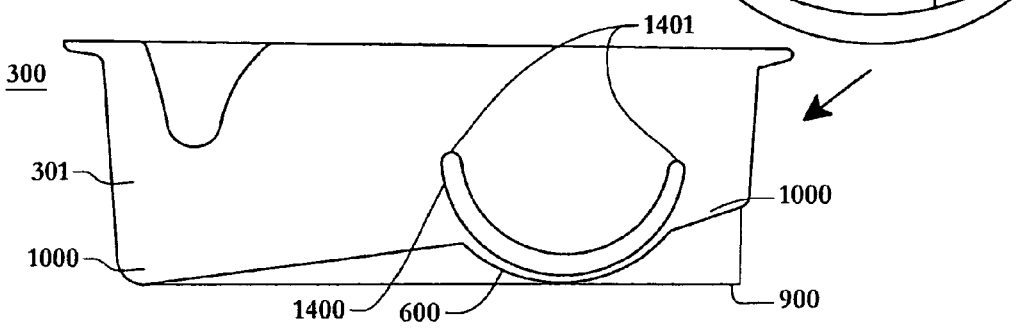
FIG. 15 is the same cross-sectional view and dual use food container as shown in FIG. 14, this is shown with a bendable food item in the position intended for food assembly, according to an embodiment of this invention.
Figure 16:
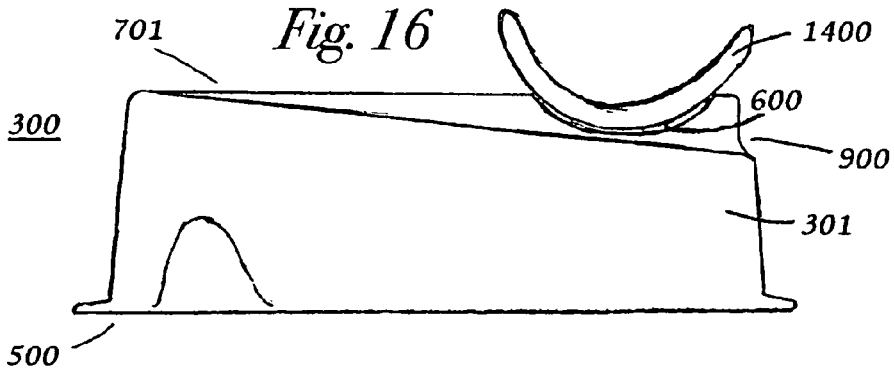
FIG. 16 is a side view of another embodiment of a dual use food container that has been turned to lay in a position intended for food assembly that shows a bendable food item held in that position according to an embodiment of this invention.

FIG. 1 through 13, all show an embodiment of the invention that is designed for a taco shell 400. Other drawings to follow show some food items of other shapes also using a dual use food container that has considered the shape and nature of the food item the container would hold. In the case of the common taco shell, the second set of surfaces FIG. 11 would share a similar but slightly larger shape than the shell it would hold. This is also described as closely enveloping. In FIG. 11 you best see this at points labeled 1100. Here both the shell and the holding surface have a U shape that function as a surface to hold the U shape of the taco. If your looking at an overhead of this FIG. 5, you will see a series of three troughs that are at least the length of the bottom of the taco shell 400 being held and between the two surfaces enough holding surface exists to hold a common taco shell 400 in the upright position that enables food preparation. This second set of surfaces are integrated into the first set of surfaces that are designed for holding shells in a horizontal position when the shells are combined 302 in the storage and transport mode. The integration of the two surfaces takes place substantially without interference with the surfaces that enable the alternative position. Additionally, the integration of the second set, can be done in a manner that creates support structure that raises the top surface 500 of the food container 300 to a parallel level so the food container 300 can now fit snugly in a box 200 from top to bottom, reducing horizontal movement that can cause breakage when the shells are held in the storage and transport mode. One should also note that a taco shell 400 as well as many other shells that are intended to be stuffed with other ingredients, would have an open end 1200 as shown on FIG. 12. When an open-ended item is stored in a package designed to envelop it, one end of that package would be larger than the other end, reflecting the shape of the open-ended item it is designed to hold. You see this illustrated in FIG. 12 the small end at 1201 and the large end at 1202. To reflect the shell 400 illustrated here, you will note in FIG. 12 that the bottom surface 1000 is sloped. The determination of second set integration considers this sloping so that food container 300 can remain adopted to fit snugly in a box 200. This requires dimensioning each of the holding surfaces 600 in relationship to the far left bottom surface point 1203, so that the top surface 500 is consistently risen to a parallel level. Conventional packaging does not do this as it will use dead zones to accomplish the box adaptation, and such dead zones do not create a second holding surface. However, in both cases using material below the ramp area 1000, does provide a buffer zone between the stored shells and the bottom box which cushions the shells stored inside when in the storage and transport position. The invention herein, takes that buffer area and also integrates the second set of holding surfaces into it. While this is illustrated with taco shells, the methodology for creating a dual use container that has like benefits would apply to any open-end shell or formed food product. The additional embodiments shown in FIG. 14-FIG. 16 illustrate how a dual use package can be created that uses a soft form food item that is bendable. In these embodiments, you will note they still contain the two sets of holding surfaces, the food container 300 is adopted to the box, and a buffer area exists 600 that performs a dual role of integrating a buffer area 600 that also has function as the second set of holding surfaces.

FIG. 14 and FIG. 15 are cross-sectional view of an embodiment of a dual use food container with the view taken along the middle line that splits the container into exact half's. FIG. 14. This is shown with bendable food items in the positions intended for food storage and transport, according to an embodiment of this invention. Note that the arc of some of the food items 1400 is different to illustrate that the food item is soft and bendable. Here we see food items 1400 found in the container 301 of the base member 300. They are stacked within the container and resting on the ramp surface 1000 which is positioned by the supporting structure 700. A formed surface 600 is contiguously integrated into the base area of the container in a manner that still allows the food items to rest in a position that enables storage and transport.

FIG. 15 is the same view as FIG. 14, yet shows only one bendable food item 1400 in the compartment 301. The food item is shown being held in the formed surface 600 in the position that enables food preparation. This is considered to be an enabling position because the food item 1400 has been bent and thus cradled by the formed surface 600, which will help the cook better direct ingredients towards the center of the food item 1400, which will also make the food item easier to eventually remove from the compartment 301. This is because of a more concentrated center of gravity and the ends of the food item 1400 are forced up on each side 1401, so that the cook can pinch the item together at this point 1401 and remove. Also note that since the food item remains in the compartment 301 during preparation any ingredient spill will be caught within the confines of the compartment 301, which helps to contain the mess.

FIG. 16 shows a different location for the formed surfaces 600 that enable food preparation for the bendable food item 1400 illustrated in FIG. 14 and FIG. 15. The base member 300 is turned over so the top surface 500 is in contact with a generally flat surface. Note that in this position the formed surfaces 600 for holding have been contiguously integrated in the supporting structure 700 and the flat surface that makes up the bottom 701 of the base member. While the base member 300 is in an upside down position, note that the compartment 301 is the same basic shape as it is shown in FIG. 14 and in this embodiment has the same ability to hold the food items 1400 in the position that enables food storage and transport as demonstrated in FIG. 14. Also this shape which has flat parallel surfaces, 500 and 701 on the top and bottom can still be adopted to fit in a box 200 in much the same manner that the previously illustrated embodiments do.

Figure 17:
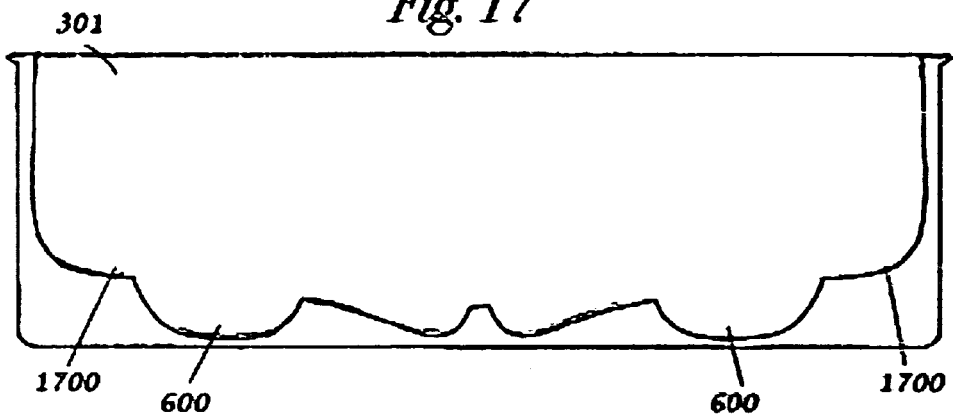
FIG. 17 is a cross-sectional view of another embodiment of a dual use food container with the view taken along the middle line that splits the container into exact half's, that shows a shape that mates with a formed food item according to an embodiment of this invention.
Figure 18:
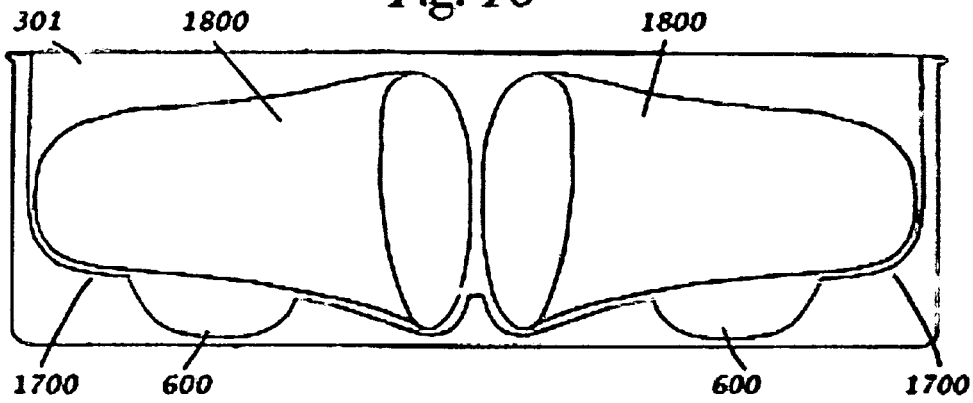
FIG. 18 is the same cross-sectional view and dual use food container as shown in FIG. 17, this is shown with a formed food item in the position intended for food storage and transport, according to an embodiment of this invention.
Figure 19:
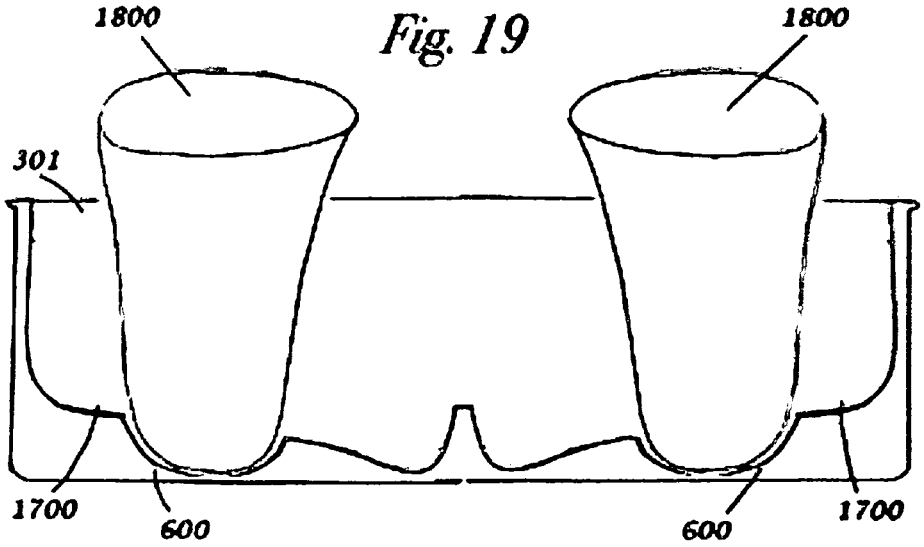
FIG. 19 is the same cross-sectional view and dual use food container as shown in FIG. 17, this is shown with a formed food item in the position intended for food assembly, according to an embodiment of this invention.

FIG. 17 is a cross-sectional view of another embodiment of a dual use food container with the view taken along the middle line that splits the base member 300 into exact half's. The shape of the compartment floor 1700 mates with the shape of the formed food item 1800 according to an embodiment of this invention. Two formed food items 1800 are shown in the storage and transport position within the compartment 301 of FIG. 18. FIG. 19 shows two shaped food items 1800 in an open and upright position that enables food preparation. Here the food item 1800 is held in this position by the formed surfaces 600 that enable food preparation that are shown in all three figures. Please also note how in each of these figures how the formed surfaces 600 are contiguously integrated into the shape of the compartment floor 1700 in a manner that does not significantly affect that floors 1700 ability to hold the items in a position for storage and transport.

FIGS. 14 through 19 are all cross sectional views of various embodiments. For these embodiments we do not show the additional views that we showed in the embodiment shown in FIGS. 1 through 13. The cross sectional views do the best job of illustrating the two separate holding surfaces with the various food items and shapes held in each. The overall package shape for these additional embodiments is similar to the shape found in FIGS. 1 through 13, as they are also designed to fit snugly in a box.

Figure 20:
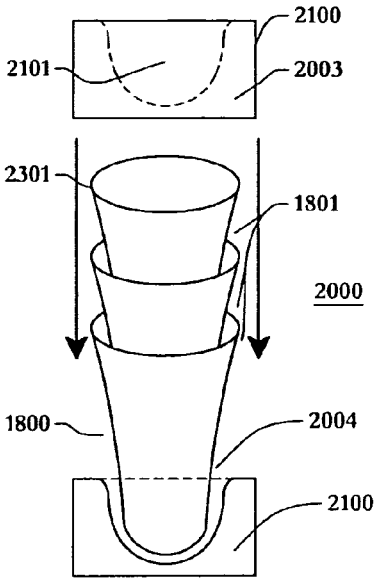
FIG. 20 is a side view of another embodiment of a dual use food container. This is also referred to as an apparatus. This is also an exploded view where the top support stand is shown above the shells that it will be inserted into. The dashed lines on top stand indicate a supporting surface that you would see if this were a cutaway view. The dashed lines on the bottom stand indicate a solid surface that if the shell were inserted into the stand you would not see the bottom part of the shell.

FIG. 20 is a side view of another embodiment of a dual use food container 2000. This is also referred to as an apparatus. This is also an exploded view where the top support stand 2001 is shown above the combined shells 1801 that it will be inserted into. The dashed lines 2003 on top stand indicate a supporting surface that you would see if this were a cutaway view. The dashed lines on the bottom stand 2004 indicate a solid surface that if the shell 1800 were inserted into the stand you would not see the bottom part of the shell 1800.

Figure 21:
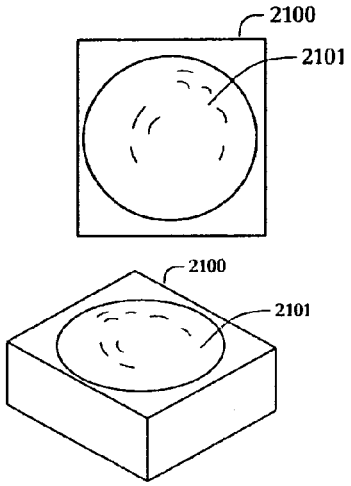
FIG. 21 is an overhead view of one of the two stands that is included in the apparatus shown in FIG. 20.

FIG. 21 is an overhead view of one of the two stands 2001 that is included in the apparatus shown in FIG. 20. The circular area 2101 is where the shell 1800 can be stood. This stand 2100 would be made out of the thin formable material that was described as being used in the dual use food container 300. In the apparatus shown in FIG. 20 the top and bottom stands 2100 are the same. When separated out of the apparatus they would each hold a minimum of one shell 2002. If we were to have an overhead view of the 2100 showing the bottom, it would be very similar, but with the perspective reversed, and the lowest point of the half globe 2101 area would be closer to the viewer while in the overhead view it would be further. This provides protection in to both the top and bottom with essentially the same design and also allows it to be adapted to a box 2200 while holding the shells 1801.

Figure 22:
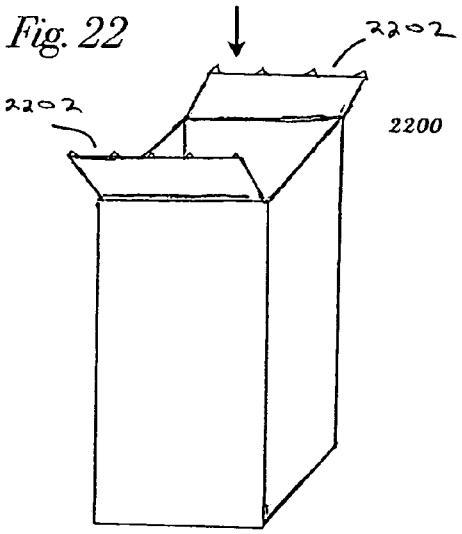
FIG. 22 is a prospective view of the package that the apparatus in FIG. 21 would be packed into. All of the pieces in FIG. 21 would go in this box and the lid closed.

FIG. 22 is a side view of the package that the apparatus 2000 in FIG. 21 would be packed into. All of the pieces in FIG. 21 would go in this box 2200 and the lid 2202 closed.

Figure 23:
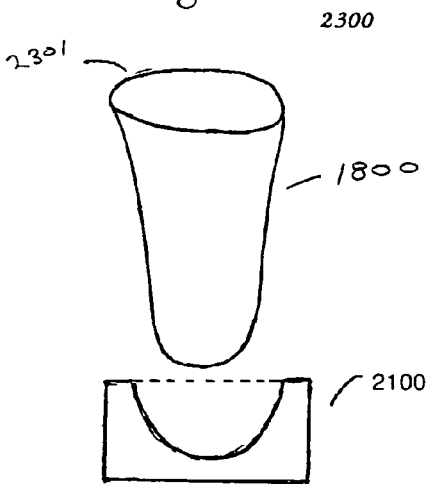
FIG. 23 is a side view of the one of the shells contained in the apparatus in FIG. 20, along with a side view of the bottom stand also shown in FIG. 20.

The stand 2100 is shown as being square; this will allow a stand 2100 to be placed within a box one on each side of the shells 1801. In this configuration you can see how the square surfaces adopt the apparatus 2000 so it fits in the box 2200 in a way that minimizes horizontal and vertical movement thus protecting the shells 1801 when enclosed in the box in the storage and transport mode. When the apparatus 2000 is unpacked the top and bottom stands 2100 can support shells 1800 in an upright position that enables food preparation, such as you can see in FIG. 23 when the shell 1800 is stood in the stand. Also note that when the top stand is put over the top of the shell 1800, then the half circle area 2003 will dip into the open end of the shell 1800 and the four sides of the 2100 will also cover over the top of the shell 1800. This will protect the top perimeter area of the shell against breakage. This is best illustrated in FIG. 20. An open end shell 1800 with a rounded bottom is used to illustrate the invention in FIG. 20-FIG. 21. The invention is in no way limited to this shape of shell. For example another embodiment of this apparatus could contain traditional U shape taco shells 400, with the stands 2100 having surfaces that best match the U shape 400. Instead of the half circle shape surface 2003, you would have a more trough like surface. The bottom side of the trough surface would also go in the top of the U shape shell 400 and would provide similar protection to the shell as we describe above that occurs for the rounded bottom shell 1800. Such an embodiment would still have top and bottom stands that when separated would hold the U shape shell 400. The box the apparatus would be contained in would have a different shape to accommodate the shape of the stand 2100 that was being used for the U shape shell 400.

Figure 24:
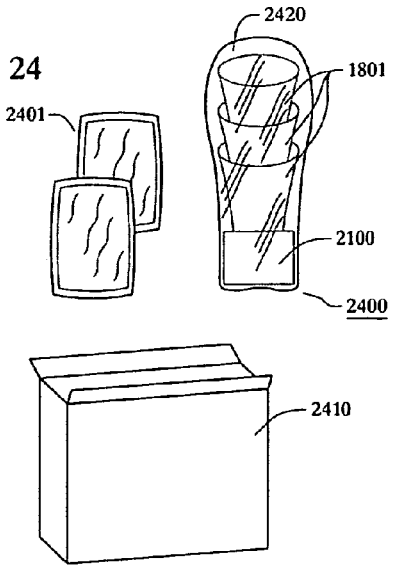
FIG. 24 is a side view of another embodiment of an apparatus that includes shells supported in a stand along with packets representing recipe ingredients.

The combination of shells 1801 that are contained in the apparatus can be sealed with a thin film 2420, in FIG. 24. This film can be applied in several different ways. One option is to seal the stand 2100 holding the shells in with the combined shells 1801 another would be to seal the shells 1801 together and then place the combined shells within the stand 1801 and then in the box 2200.

More than one stand 1801 can be used to protect the shells, in FIG. 24 we show just one stand being used, but one could instead place stands on the top and bottom of the shells like what is shown in FIG. 20. Also the stands, because they are made of a thin material and match each other in size and dimension can be placed into each other. This would take up very little additional room in the box 2200 and would allow more stands to be offered within the apparatus. A typical arrangement would be a total of 12 shells 1800 offered in each package along with 12 stands 2100.

FIG. 24 is a side view of another embodiment of an apparatus 2400 that includes shells 1801 supported in a stand 2100 along with packets 2401 representing recipe ingredients. The entire apparatus would be packed into the box 2410 that is shown. The shells and stand are sealed with a thin film 2420. The stand 2100 can help position the shells in the box 2410 so that horizontal and lateral movement is minimized. As mentioned before, the package within the box that contains the combination of shells and stands could also have a stand on the top and bottom like that shown in FIG. 20. With this configuration one way that would reduce the movement would be to pack it horizontally in the bottom area of the box 2410.

Figure 25:
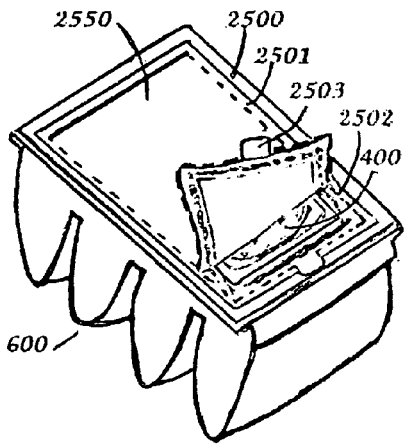
FIG. 25 is a perspective view of another embodiment of a dual use food container shown with a re-sealable closure according to an embodiment of this invention.

FIG. 25 is a perspective view showing how an embodiment of a dual use food container would not require a box, that a seal 2550 would be attached to the base member. The seal could allow easy resealing using a film with permanent glue that is affixed to the perimeter of the top of the box all the way around the perimeter of the top surface in the space labeled 2500. A perforated line 2501 divides an area that uses repositionable glue that is also affixed to the top of the box in the area 2502 that is closer to the food compartment; and a tab 2503 that function with the part that has repositionable glue. When open the food item 400 is exposed which is held in the compartment 301 that includes the formed surfaces that hold the food in an upright position that enables food preparation.

Figure 26:
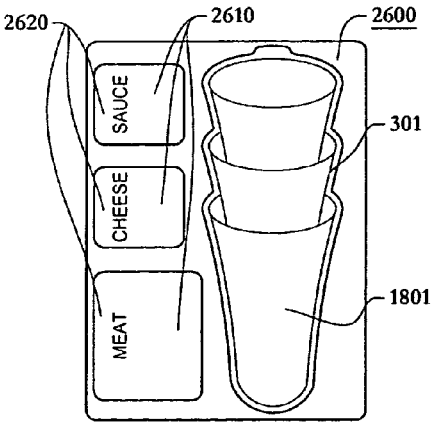
FIG. 26 is an overhead view of a dual use food container, that has a dual use compartment that contains a multiple of shells that is adjacent to other compartments that could contain recipe ingredients that would typically be placed within the shell.

FIG. 26 is an overhead view of a dual use food container 2600, also referred to as an apparatus that has a dual use compartment 301 that contains a multiple of shells 1801 that is adjacent to other compartments 2610 that could contain recipe ingredients 2620 that would typically be placed within the shell. Also note, although not illustrated here that adjacent to the first compartment could also be another similar dual use compartment and that there is nothing that would prohibit multiple combinations of dual use compartments and additional compartments that contain recipe or other ingredients.

Figure 27:
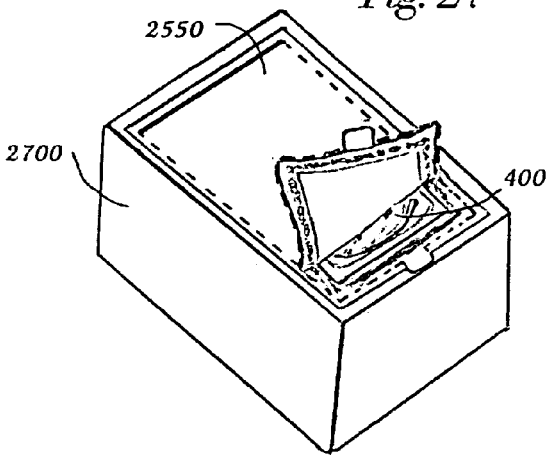
FIG. 27 is a perspective view of another embodiment of a dual use food container shown in FIG. 25 with a reseal-able closure according to an embodiment of this invention.

FIG. 27 is a perspective view of a food container in FIG. 25 encased within a box 2700 and is shown using the re-sealable seal 2550 that is also illustrated in FIG. 25.

Figure 28:
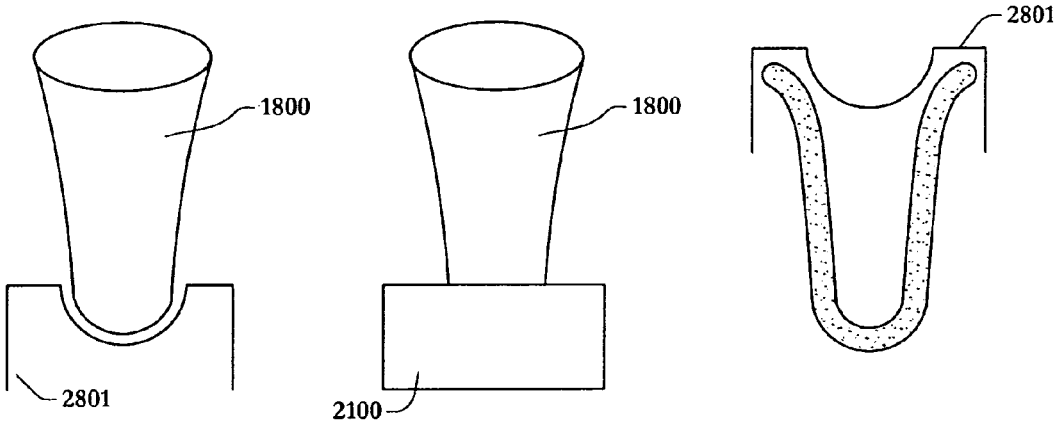
FIG. 28 shows three shells and the stand with each the diagrams on the right and left are cutaway views.

FIG. 28 shows three shells 1800 with the stand 2100. The left one shows a cutaway stand 2801, note how it is the same as the one shown on top of the shells in the figure on the right side. The one in the middle is not a front view and all you see concerning the stand 2100 is the solid front. However when you see them cutaway you can now see the half moon 2003 shaped support surface. Note when it is placed on top it protects the perimeter of the 1800, and even protects the inside of the shell. When the stand 2100 is on the bottom you can stand the shell 1800 in it.

FIG. 2, FIG. 3 and FIG. 4, also illustrate a method. FIG. 2 the food container 100 is removed from the box 201 and the food is exposed by removing the seal 303. The food items 302 are then set in a separate area, and can be prepared further; one example would be warming the food items 302 in an oven to a desired temperature.

An additional step would be for the food item 400 to be individually returned to the food container 100 and placed in an upright position that enables food preparation. This is shown in FIG. 4, the food container is holding one food item 400, however more food items 400 can be added based on the size of the shell and the space in the food container and they can even be stacked on top of each other as illustrated in FIG. 12. Once the food item is upright the cook can add ingredients within the food item 400 to complete the recipe. FIG. 1. shows three such food items standing upright in the container 300 with ingredients added. Once this has occurred the user can then move the food item with ingredients out of the container so it can be placed elsewhere or eaten. Said food item with ingredients can be returned to the compartment at least once during the eating process, so that the food compartment will hold the partially eaten food item in an upright position, said food can be removed and returned continually till the food is consumed.

An additional step that is incorporated into the method involves warming the shell 400 when placed in the upright position in the container 300. To do this safely the container 300 would have to be made out of heat resistant material suited for the desired temperature the food item would be warmed to. An additional step that could also be taken during the process of warming the shell 400 in the container 300 would be inserting the ingredients that complete the recipe, so they would also get warmed together. For example you could insert cold cooked ground beef into the shell 400 which would then go in upright in the food container as seen in FIG. 1. The food container would then go in an oven to be warmed to the desired temperature.

What is claimed is:

1. A vessel comprising:

a base member having at least one compartment, wherein a base member compartment comprises a supporting plane having at least one pair of ridges forming at least one groove extending into and below the supporting plane and having predetermined dimensions corresponding to an aspect of a fillable food item and side walls connected to and perpendicular to the base of the compartment, wherein at least one side wall comprises at least one pair of ridges forming at least one outwardly extending groove having predetermined dimensions corresponding to an aspect of the food item, whereby supporting plane ridges and ridges of the side walls form an integrated support surface within the base member compartment that supports the food item in an orientation parallel to the side walls for storage or transport and, alternately, supports the food item in an upright position to receive ingredients.

2. The vessel of claim 1, wherein the ridges supporting plane comprises ridges adapted to minimize horizontal movement and lateral movement of fillable food items when placed in the base member compartment.

3. The vessel of claim 1, wherein the at least one groove formed by a pair of supporting plane ridges is capable of holding the item in an upright position when the vessel is inverted.

4. The vessel of claim 1, wherein the fillable food item is bendable.

5. The vessel of claim 1, wherein at least one aspect of the fillable food item is curved or U-shaped.

6. The vessel of claim 1, further comprising a film.

7. The vessel of claim 6, wherein the film is resealable.

8. The vessel of claim 1, wherein the vessel comprises a contiguous piece of molded heat resistant material.

9. The vessel of claim 1, wherein the at least one-groove extending into and below the supporting plane extends down to contact a support surface when the vessel is rested on a support surface.

10. The vessel of claim 1, wherein the supporting plane is sloped.

* * * * *